US009260813B2

(12) United States Patent
Bae et al.

(10) Patent No.: US 9,260,813 B2
(45) Date of Patent: Feb. 16, 2016

(54) MOTOR USABLE WITH WASHING MACHINE AND WASHING MACHINE HAVING THE SAME

(75) Inventors: Il Sung Bae, Gyeonggi-do (KR); Moo Hyung Lee, Seoul (KR); Jae Seuk Park, Gyeonggi-do (KR); Sung Jin Cho, Gyeonggi-do (KR); Sung Jong Kim, Gyeonggi-do (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 809 days.

(21) Appl. No.: 13/551,803

(22) Filed: Jul. 18, 2012

(65) Prior Publication Data

US 2013/0025330 A1 Jan. 31, 2013

(30) Foreign Application Priority Data

Jul. 27, 2011 (KR) ..... 10-2011-0074460

(51) Int. Cl.
*D06F 37/30* (2006.01)
*D06F 37/22* (2006.01)

(52) U.S. Cl.
CPC ..... *D06F 37/304* (2013.01); *D06F 37/225* (2013.01)

(58) Field of Classification Search
CPC ..... D06F 37/225; D06F 37/304
USPC ..... 310/68 B, 50, 40 R, 113; 68/140
See application file for complete search history.

(56) References Cited

U.S. PATENT DOCUMENTS 5,913,951 A 6/1999 Herr et al.
8,201,317 B2 * 6/2012 Ganong ..... F16C 3/02 29/598
2004/0139768 A1 * 7/2004 Kim ..... D06F 37/304 68/12.24
2010/0050702 A1 * 3/2010 Kim ..... D06F 37/304 68/23 R

FOREIGN PATENT DOCUMENTS

EP 1529870 5/2005
JP 2010-269426 12/2010
JP 2010-288427 12/2010

(Continued)

OTHER PUBLICATIONS

International Search Report mailed Dec. 28, 2012 in International Patent Application PCT/KR2012/005881.
Extended European Search Report dated Oct. 9, 2012 in European Application No. 12175901.3-2314.
Notice of Allowance dated Apr. 29, 2015 from Canadian Patent Application No. 2,842,915, 1 page.

(Continued)

*Primary Examiner* — Michael Barr
*Assistant Examiner* — Rita Adhlakha
(74) *Attorney, Agent, or Firm* — Staas & Halsey LLP

(57) ABSTRACT

Disclosed herein are a motor usable with a washing machine, which includes a drive shaft to enable supply of electric power to an electric device within a drum, and a washing machine having the same. The washing machine may include a cabinet, a tub placed within the cabinet, a drum rotatably placed within the tub and configured to accommodate laundry therein, at least one electric device mounted to the drum and configured to be operable by electric power, a motor including a ring-shaped stator mounted to a rear wall of the tub and a rotor placed around the stator so as to be rotated via electromagnetic interaction with the stator, the motor being driven by an external power source, and an electric power generating device including a power-generation unit to generate electric power to be transmitted to the electric device via driving of the motor.

27 Claims, 10 Drawing Sheets

(56) References Cited

FOREIGN PATENT DOCUMENTS

| | | |
|---|---|---|
| KR | 1997-0027465 | 6/1997 |
| KR | 10-1997-0065850 | 10/1997 |
| KR | 10-0154665 | 12/1998 |
| KR | 2000-0077232 | 12/2000 |
| KR | 10-2005-0050230 | 5/2005 |
| WO | 2011/115384 | 9/2011 |

OTHER PUBLICATIONS

Korean Office Action dated Mar. 20, 2015 from Korean Patent Application No. 10-2011-0074460, 7 pages.

Decision of Grant dated Mar. 3, 2015 from Russian Patent Application No. 2014107482/12(011770), 12 pages.

Australian Office Action dated Feb. 25, 2015 from Australian Patent Application No. 2012287653, 2 pages.

* cited by examiner

MOTOR USABLE WITH WASHING MACHINE AND WASHING MACHINE HAVING THE SAME

CROSS-REFERENCE TO RELATED APPLICATIONS

This application claims the priority benefit of Korean Patent Application No. 10-2011-0074460, filed on Jul. 27, 2011 in the Korean Intellectual Property Office, the disclosure of which is incorporated herein by reference.

BACKGROUND

1. Field

Embodiments of the present disclosure relate to a washing machine having a configuration to supply electric power to a drum of the washing machine.

2. Description of the Related Art

A washing machine serves to wash clothes using electric power. A general washing machine includes a tub to accommodate wash water therein, a drum rotatably installed within the tub, and a motor to enable rotational driving of the drum.

If the drum is rotated by the motor in a state in which laundry and wash water containing detergent are input into the drum, contaminants adhered to the laundry are removed via friction between the laundry, drum and wash water containing detergent.

Washing machines may be divided into indirect-drive type washing machines in which power of a motor is transmitted to a drum via a power transmission mechanism, such as a belt and a pulley, and direct-drive type washing machines in which power of a motor is directly transmitted to a shaft of a drum.

In a direct-type type washing machine, a motor includes a stator mounted to a tub, a rotor arranged around the stator to electromagnetically interact with the stator, and a drive shaft to transmit rotational power of the rotor to a drum.

The drum may be provided with an electric device to be driven by electric power, which may require a complex configuration for connection of an electric wire used to supply electric power to the electric device.

In addition, it may be necessary to mount an external power source to supply electric power to the electric device within a cabinet of the washing machine, which may increase the size of the cabinet.

SUMMARY

Therefore, it is one aspect of the present invention to provide a motor usable with a washing machine, which exhibits self-power generation, and a washing machine having the same.

It is another aspect of the present invention to provide a motor usable with a washing machine, which includes a drive shaft to enable supply of electric power to an electric device within a drum, and a washing machine having the same.

Additional aspects of the invention will be set forth in part in the description which follows and, in part, will be apparent from the description, or may be learned by practice of the invention.

In accordance with one aspect of the present invention, a washing machine includes a cabinet, a tub placed within the cabinet, a drum rotatably placed within the tub and configured to accommodate laundry therein, at least one electric device mounted to the drum and configured to be operable by electric power, a motor including a ring-shaped stator mounted to a rear wall of the tub and a rotor placed around the stator so as to be rotated via electromagnetic interaction with the stator, the motor being driven by an external power source, and an electric power generating device including a power-generation unit to generate electric power to be transmitted to the electric device mounted to the drum via driving of the motor.

The power-generation unit may include a plurality of magnets affixed in a circumferential direction to a surface of the stator adjacent to the rotor, and a plurality of coils affixed in the circumferential direction at positions corresponding to the plurality of magnets to a surface of the rotor adjacent to the stator, and the power-generation unit may generate electric power by electromagnetic interaction between the plurality of magnets and the plurality of coils.

The power-generation unit may include a rib protruding rearward from a rear surface of the tub in a circumferential direction, and a generator placed at a radial lateral surface of the rotor so as to come into contact with the rib, the generator may generate being rotatable about an axis thereof, and the generator may generate electric power by being rotated via friction with the rib when the rotor is rotated by the external power source.

The electric power generating device may further include a drive shaft having one end connected to a rear plate of the drum and the other end connected to the motor, the drive shaft being configured to define a passage to transmit rotational power of the motor to the drum and to transmit electric power generated by the power-generation unit to the at least one electric device.

The drive shaft may take the form of a hollow circular column to allow passage of an electric wire through the hollow drive shaft.

The drive shaft may take the form of a circular column and may be provided with a longitudinal groove in a curved peripheral surface of the circular column to allow passage of an electric wire along the groove.

The drive shaft may be formed as a conductor for transmission of electricity.

The at least one electric device may include a balancing device drive unit.

The at least one electric device may include a light emitting unit to illuminate the interior of the drum.

In accordance with another aspect of the present invention, a washing machine includes a cabinet, a tub placed within the cabinet, a drum rotatably placed within the tub and configured to accommodate laundry therein, at least one electric device mounted to the drum and configured to be operable by electric power, a motor mounted to a rear wall of the tub and serving to rotate the drum, and a drive shaft having one end connected to a rear plate of the drum and the other end connected to the motor, the drive shaft being configured to transmit rotational power of the motor to the drum and to allow an electric wire to extend to the at least one electric device.

The drive shaft may take the form of a hollow circular column to allow passage of the electric wire through the hollow drive shaft.

The drive shaft may take the form of a circular column and may be provided with a longitudinal groove in a curved peripheral surface of the circular column to allow passage of the electric wire along the groove.

The drive shaft may be formed as a conductor for transmission of electricity.

The washing machine may further include a power source placed within the cabinet so as to supply electric power, and the electric power supplied by the power source may be transmitted to the at least one electric device through the drive shaft.

The washing machine may further include a slip ring provided behind the motor and configured to enable supply of electric power from the power source to the at least one electric device even if the drum is rotated.

In accordance with another aspect of the present invention, a washing machine includes a tub, a drum rotatably placed within the tub and configured to accommodate laundry therein, a ring-shaped stator mounted to a rear wall of the tub, a rotor placed to surround the stator and serving to rotate the drum, a plurality of magnets affixed in a circumferential direction to a surface of the stator adjacent to the rotor, a plurality of coils affixed to an inner surface of the rotor at positions corresponding to the plurality of magnets, a drive shaft connected to a rear surface of the drum, one end of the drive shaft protruding rearward from a rear surface of the tub being connected to the rotor, the drive shaft taking the form of a hollow circular column, and an electric wire having one end connected to the plurality of coils, the electric wire passing through the hollow drive shaft and extending along an outer surface of the drum.

In accordance with another aspect of the present invention, a washing machine includes a tub, a drum rotatably placed within the tub and configured to accommodate laundry therein, a ring-shaped stator mounted to a rear wall of the tub, a rotor placed to surround the stator and serving to rotate the drum, a rib protruding rearward from a rear surface of the tub in a circumferential direction, a generator placed between a radial lateral surface of the rotor and the rib and adapted to rotate about an axis thereof, a drive shaft connected to a rear surface of the drum, one end of the drive shaft protruding rearward from the rear surface of the tub being connected to the rotor, the drive shaft taking the form of a hollow circular column, and an electric wire having one end connected to the generator, the electric wire passing through the hollow drive shaft and extending along an outer surface of the drum.

In accordance with another aspect of the present invention, a washing machine includes a tub, a drum rotatably placed within the tub and configured to accommodate laundry therein, a ring-shaped stator mounted to a rear wall of the tub, a rotor placed to surround the stator and serving to rotate the drum, a power source placed at the outside of the tub so as to supply electric power, a drive shaft connected to a rear surface of the drum, one end of the drive shaft protruding rearward from a rear surface of the tub being connected to the rotor, the drive shaft taking the form of a hollow circular column, an electric wire having one end connected to the power source, the electric wire passing through the hollow drive shaft and extending along an outer surface of the drum, and a slip ring provided behind the rotor and serving to prevent twisting of the electric wire even if the rotor is rotated.

In accordance with another aspect of the present invention, a motor usable with a washing machine includes a ring-shaped stator, a rotor placed around the stator so as to be rotatable via electromagnetic interaction with the stator when external power is applied thereto, a drive shaft having one end connected to the rotor so as to rotate together with the rotor, and a power-generation configured to generate electric power separately from the external power.

The drive shaft may take the form of a hollow circular column to allow passage of an electric wire through the hollow drive shaft.

The power-generation unit may include a plurality of magnets affixed in a circumferential direction to a surface of the stator adjacent to the rotor, and a plurality of coils affixed in the circumferential direction at positions corresponding to the plurality of magnets to a surface of the rotor adjacent to the stator.

The power-generation unit may include a generator placed at a radial lateral surface of the rotor, the generator being rotatable about an axis thereof, and a rib placed to surround the rotor so as to come into contact with a surface of the generator, an opposite surface of the generator being adjacent to the rotor.

In accordance with a further aspect of the present invention, a motor usable with a washing machine, includes a ring-shaped stator, a rotor placed around the stator so as to be rotatable via electromagnetic interaction with the stator, a drive shaft having one end connected to the rotor so as to rotate together with the rotor, the drive shaft taking the form of a hollow circular column to allow passage of an electric wire through the hollow drive shaft, and a slip ring provided behind the rotor, the slip ring being configured to allow the electric wire extending from an external power source to extend through the hollow drive shaft and to prevent twisting of the electric wire even if the rotor is rotated.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
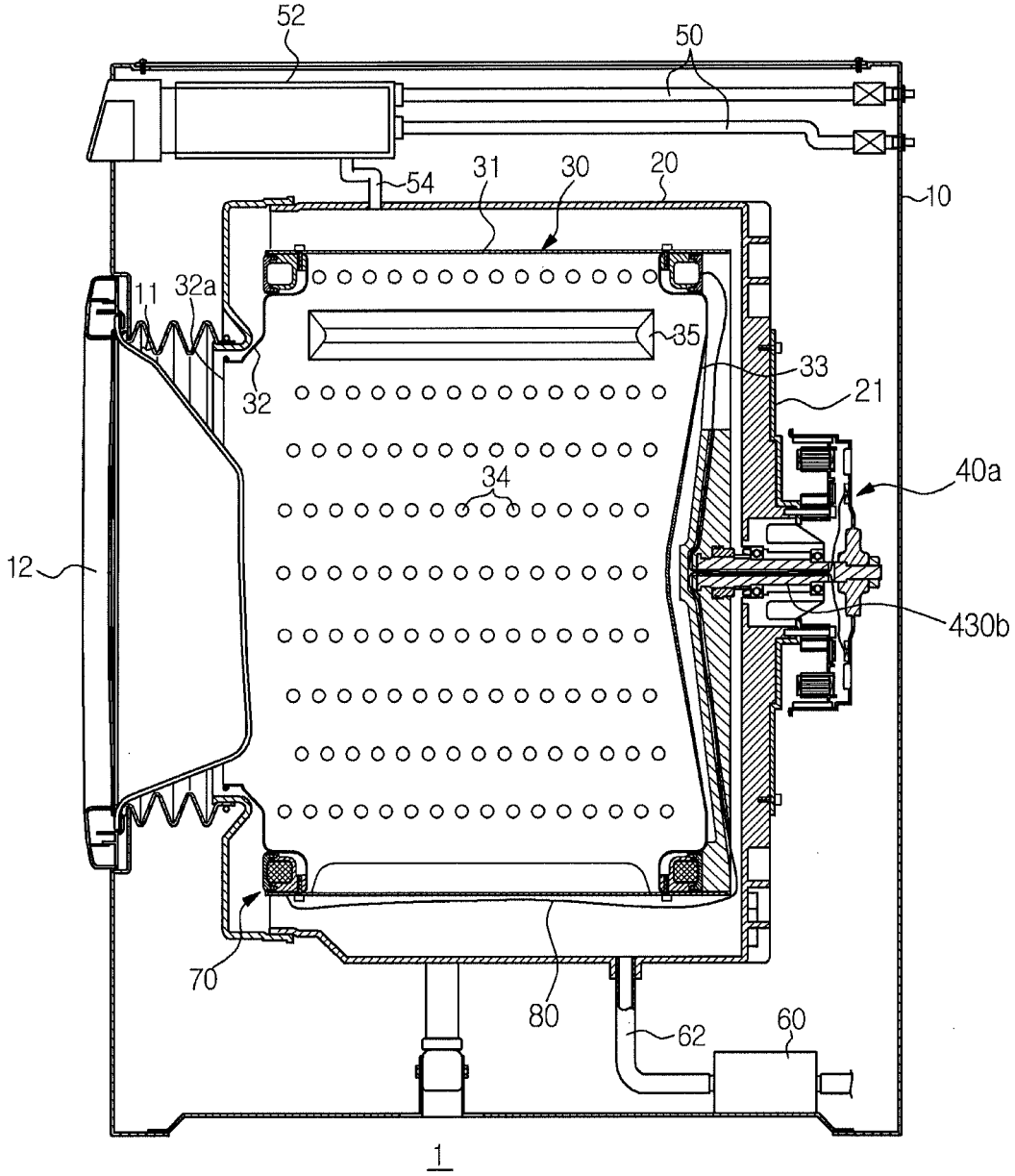
FIG. 1 is a view illustrating the configuration of a washing machine in accordance with an embodiment of the present invention.

Reference will now be made in detail to the embodiments of the present invention, examples of which are illustrated in the accompanying drawings, wherein like reference numerals refer to like elements throughout.

FIG. 1 is a view illustrating the configuration of a washing machine in accordance with an embodiment of the present invention.

As illustrated in FIG. 1, the washing machine 1 includes a cabinet 10 defining the external appearance of the washing machine 1, a tub 20 placed within the cabinet 10, a drum 30 rotatably placed within the tub 20, and a motor 40*a* to drive the drum 30.

The cabinet 10 is provided at a front side thereof with an entrance 11 through which laundry is input into the drum 30.

The entrance 11 is opened or closed by a door 12 installed to the front side of the cabinet 10.

A water supply pipe 50 is installed above the tub 20 and serves to supply wash water into the tub 20. One end of the water supply pipe 50 is connected to an external water source (not shown) and the other end of the water supply pipe 50 is connected to a detergent feeding device 52.

The detergent feeding device 52 is connected to the tub 20 using a connecting pipe 54. The water supplied through the water supply pipe 50 is introduced into the tub 20 along with detergent by way of the detergent feeding device 52.

A drain pump 60 and a drain pipe 62 are installed below the tub 20 and serve to discharge the interior water of the tub 20 to the outside of the cabinet 10.

The drum 30 includes a cylindrical body 31, a front plate 32 affixed to a front end of the cylindrical body 31 and a rear plate 33 affixed to a rear end of the cylindrical body 31. The front plate 32 is provided with an opening 32*a* for entrance/exit of laundry.

A plurality of through-holes 34 for passage of wash water is perforated in the periphery of the drum 30. Also, a plurality of lifters 35 is provided at an inner peripheral surface of the drum 30 to raise and drop laundry during rotation of the drum 30.

A drive shaft 430*b* is placed between the drum 30 and the motor 40*a*. One end of the drive shaft 430*b* is connected to the rear plate 33 of the drum 30, and the other end of the drive shaft 430*b* extends outward of a rear surface 21 of the tub 20. If the motor 40*a* drives the drive shaft 430*b*, the drum 30 connected to the drive shaft 430*b* is rotated about the drive shaft 430*b*.

In a washing operation, the motor 40*a* rotates the drum 30 forward or rearward at a low speed and thus, laundry within the drum 30 is repeatedly raised and dropped, enabling removal of contaminants from the laundry.

In a dehydrating operation, the motor 40*a* rotates the drum 30 at a high speed in a given direction, causing water to be separated from the laundry by applying centrifugal force to the laundry.

If the laundry is gathered on a particular region rather than being evenly distributed within the drum 30 while the drum 30 is rotated to perform the dehydrating operation, the drum 30 exhibits unstable rotation and thus, generation of vibration and noise. For this reason, the washing machine 1 further includes a balancing device 70 to stabilize rotational motion of the drum 30.

One end of an electric wire 80 is connected to the motor 40*a* and extends through the drive shaft 430*b* until the other end of the electric wire 80 is connected to the balancing device 70.

The electric wire 80 connected to the balancing device 70 takes charge of the supply of electric power to the balancing device 70.

The motor 40*a* includes a power-generation unit (not shown) to generate electric power, and the electric power is supplied to the balancing device 70 through the electric wire 80. Although only the balancing device 70 to receive electric power is illustrated in the drawing, other electric devices to be driven by electric power may be provided. The configuration of the power-generation unit will be described below with reference to FIGS. 2 and 3.

The configuration of the drive shaft 430*b* for penetration of the electric wire 80 will be described below with reference to FIGS. 4A, 4B and 4C.

Figure 2:
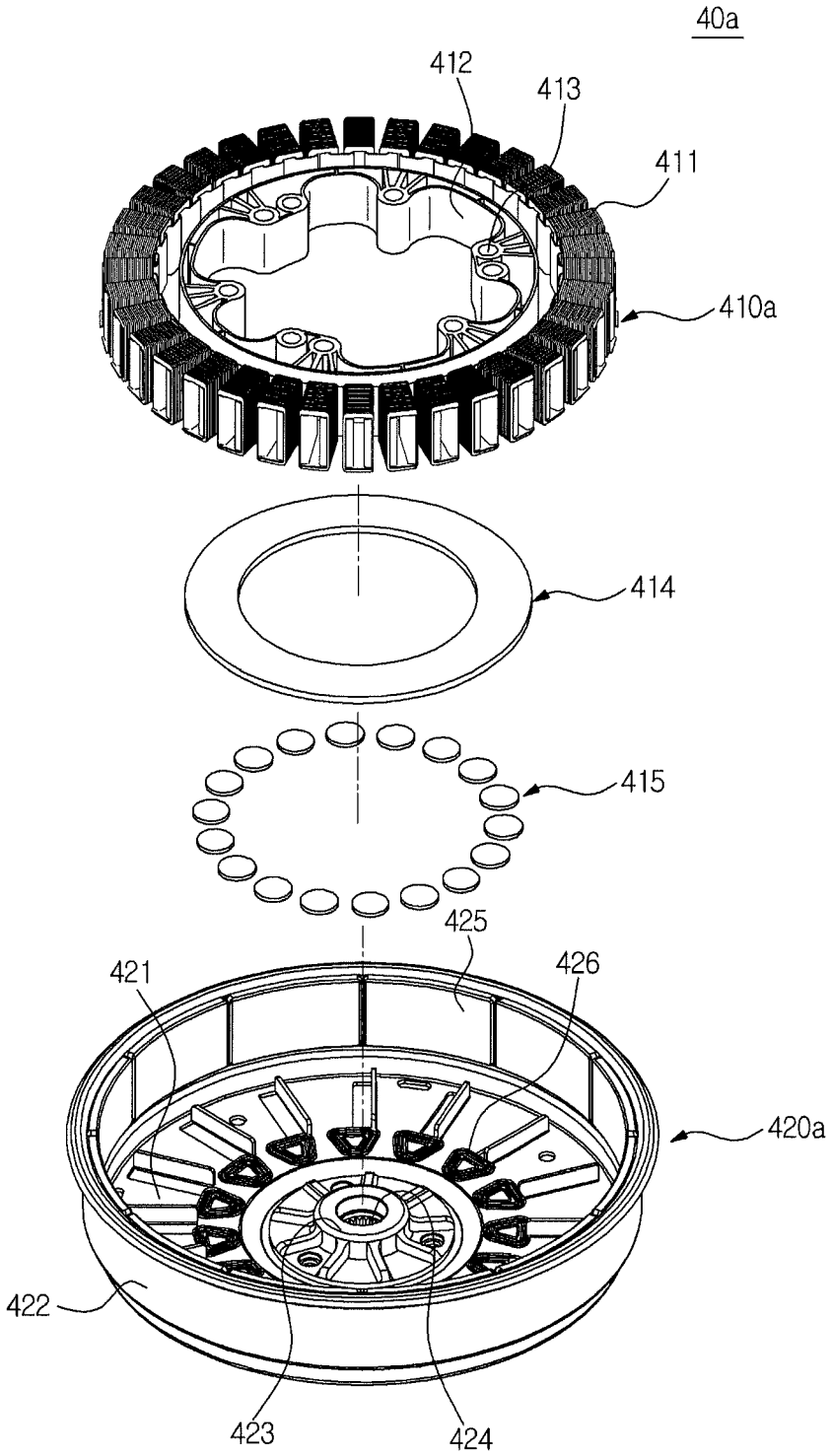
FIG. 2 is a perspective view illustrating the configuration of a motor usable with a washing machine in accordance with an embodiment of the present invention.
Figure 3:
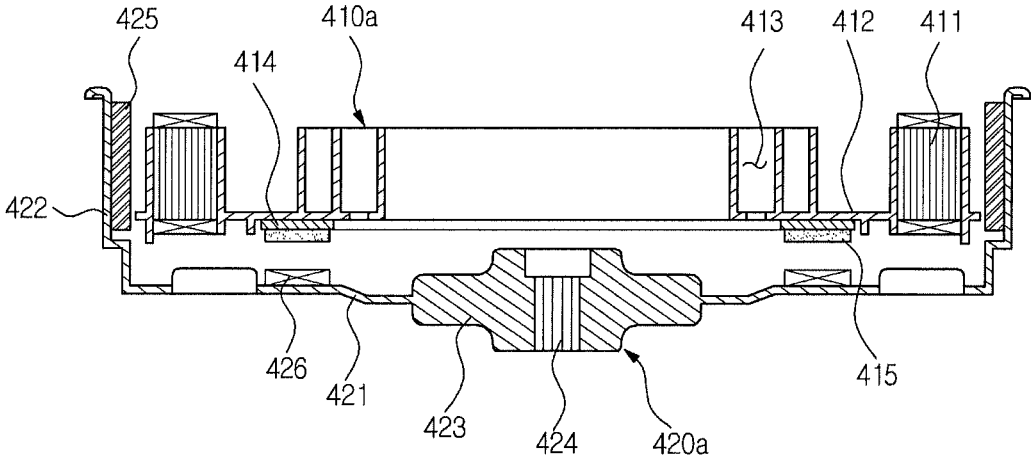
FIG. 3 is a sectional view of the motor illustrated in FIG. 2.

FIG. 2 is a perspective view illustrating the configuration of the motor usable with the washing machine in accordance with an embodiment of the present invention, and FIG. 3 is a sectional view of the motor illustrated in FIG. 2.

As illustrated in FIGS. 2 and 3, the motor 40*a* includes a stator 410*a* mounted to the rear surface (21, see FIG. 1) of the tub (20, see FIG. 1), and a rotor 420*a* placed around the stator 410*a* and adapted to be rotated by electromagnetic interaction with the stator 410*a*.

The stator 410*a* includes a stator core (not shown), an insulator (not shown), and a plurality of coupling pieces 412 to mount a stator coil 411 and the stator 410*a* to the rear surface 21 of the tub 20.

The stator 410*a* includes a plurality of protrusions extending outward from an outer periphery of a doughnut-shaped annular base in a radial direction of the stator 410*a*. The stator coil 411 is wound on the plurality of protrusions.

The plurality of coupling pieces 412 is arranged in a circumferential direction of the stator 410*a* at inward positions with respect to the radial direction of the stator 410*a*.

The coupling pieces 412 respectively have coupling holes 413, into which fastening members (not shown), such as bolts, etc., are insertable.

As the fastening members are inserted into the coupling holes 413, the stator 410*a* is mounted to the rear surface 21 of the tub 20.

A doughnut-shaped annular plate 414 is attached to a rear surface of the stator 410*a* at an opposite side of a surface mounted to the rear surface 21 of the tub 20 and in turn, a plurality of power-generation unit magnets 415 is seated on the annular plate 414.

The plurality of power-generation unit magnets 415 seated on the plate 414 is arranged in a circumferential direction.

The rotor 420*a* includes an annular bottom 421 and a sidewall 422 protruding from the rim of the bottom 421 and is configured to surround the stator 410*a*.

A plurality of rotor magnets 425 is circumferentially affixed to an inner surface of the sidewall 422. The rotor magnets 425 are arranged to face the stator coil 411 with a predetermined gap therebewteen so as to electromagnetically interact with the stator coil 411.

The bottom 421 is provided with a mount 423, which protrudes so as to be adjacent to the stator 410*a*.

The mount 423 is perforated with a central mounting bore 424, and the drive shaft (430*b*, see FIG. 1) extending outward from the tub 20 is fitted at an end thereof into the mounting bore 424.

The bottom 421 is further provided with a plurality of power-generation unit coils 425 arranged in a circumferential direction at positions facing the respective power-generation unit magnets 415.

Hereinafter, operation of the motor 40*a* will be described.

A magnetic field is created if current is applied to the stator coil 411, and the rotor 420*a* is rotated by the magnetic field created by the stator coil 411 and a magnetic field created by the rotor magnets 425.

In the relative relationship between the power-generation unit magnets 415 and the power-generation unit coil 426 caused by rotation of the rotor 420*a*, a magnetic flux density between the power-generation unit magnets 415 and the power-generation unit coil 426 varies, causing electric current to be applied to the power-generation unit coil 426.

With the above-described operation, the rotor 420*a* is rotated and the power-generation unit coils 426 generate electric power.

An electric wire is used to transmit the electric power generated by the power-generation unit coils 426 to an electric device, such as the balancing device (70, see FIG. 1). Connection of the electric wire is realized using the configuration of the drive shaft for penetration of the electric wire through the rear surface 21 of the tub 20.

The configuration of the drive shaft will be described below with reference to FIGS. 4A, 4B and 4C.

Although embodiments of three types of drive shafts are described herein, the embodiments have a common feature that one end 431 of the drive shaft is fastened into the mounting bore 424 of the rotor 420*a* and the other end 432 penetrates the rear surface 21 of the tub 20 and is connected to the rear plate 33 of the drum 30.

Figure 4A:
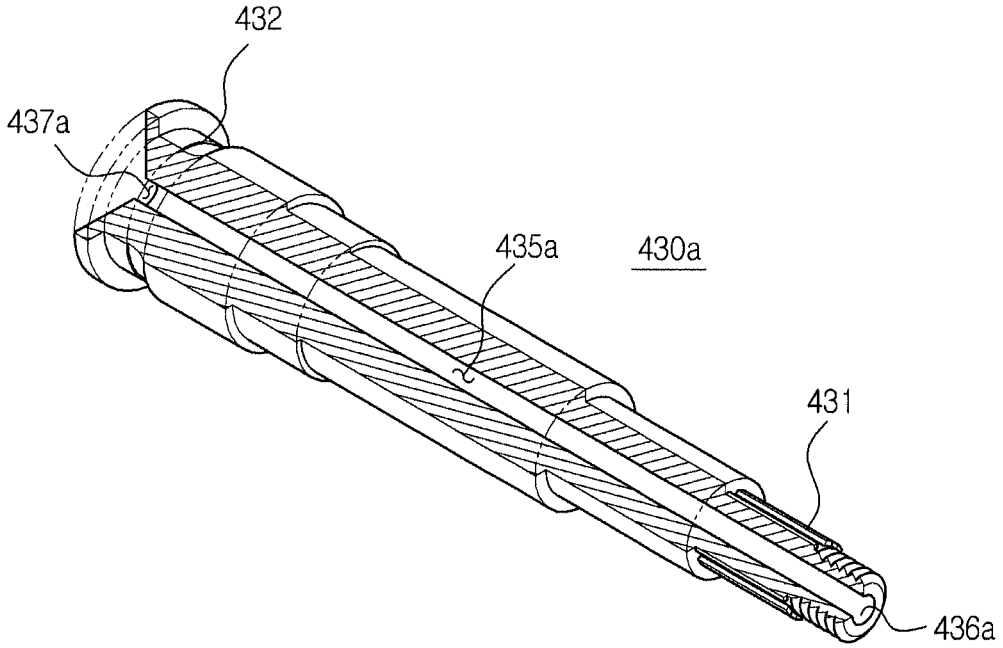
FIG. 4A is a view illustrating a drive shaft in accordance with one embodiment of the present invention.

FIG. 4A is a view illustrating a drive shaft in accordance with one embodiment of the present invention.

As illustrated in FIG. 4A, a drive shaft 430*a* has an elongated hollow bar shape and includes a bore 435*a* perforated in the entire longitudinal direction of the drive shaft.

The electric wire 80 extends outward through a first hole 436*a* of the drive shaft 430*a* to thereby be connected to the power-generation unit and also, extends into the tub 20 through a second hole 437*a* to thereby be connected to the electric device, such as the balancing device (70, see FIG. 1).

Figure 4B:
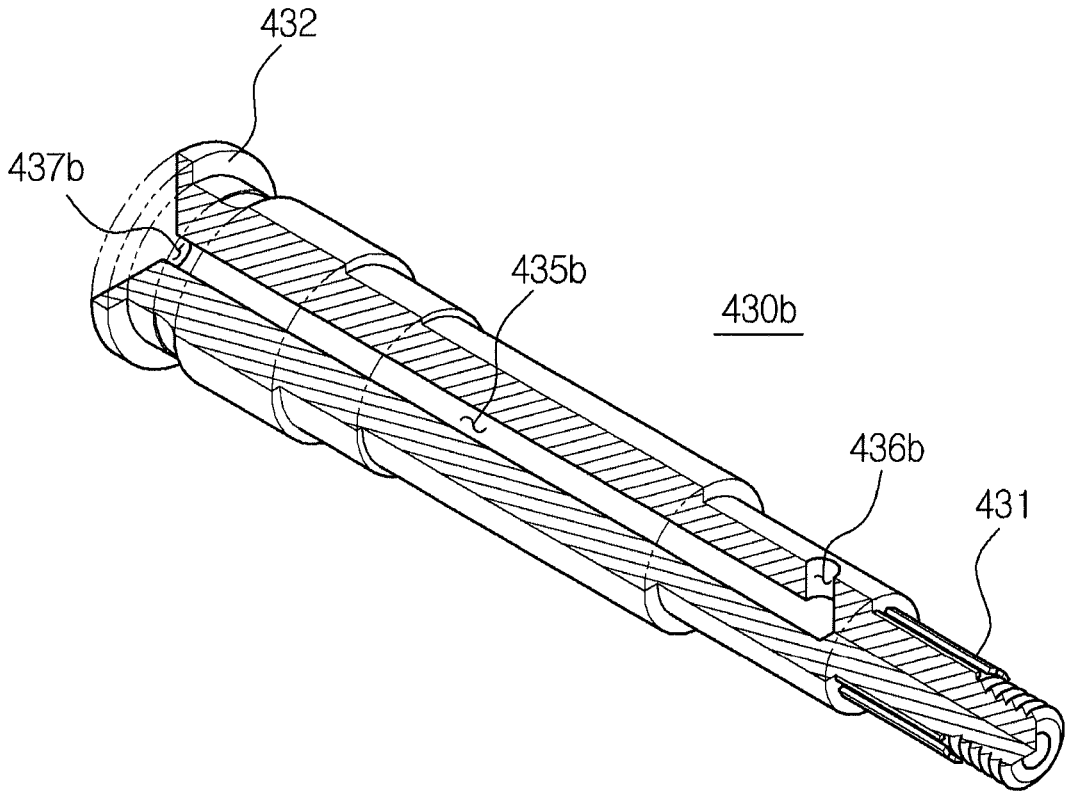
FIG. 4B is a view illustrating a drive shaft in accordance with another embodiment of the present invention.

FIG. 4B is a view illustrating a drive shaft in accordance with another embodiment of the present invention.

As illustrated in FIG. 4B, the drive shaft 430*b* has an elongated hollow bar shape and includes a bore 435*b* in a longitudinal direction of the drive shaft.

The bore 435*b* does not reach a distal portion of the end 431 of the drive shaft 430*b* and is bent to a peripheral surface of the drive shaft 430*b*. Thus, a first hole 436*b* is located at the peripheral surface of the drive shaft 430*b* and a second hole 437*b* is located at a distal portion of the other end 432 of the drive shaft 430*b*.

The electric wire 80 extends outward through the first hole 436*b* of the drive shaft 430*b* to thereby be connected to the power-generation unit and also, extends into the tub 20 through the second hole 437*b* to thereby be connected to the electric device, such as the balancing device (70, see FIG. 1).

Figure 4C:
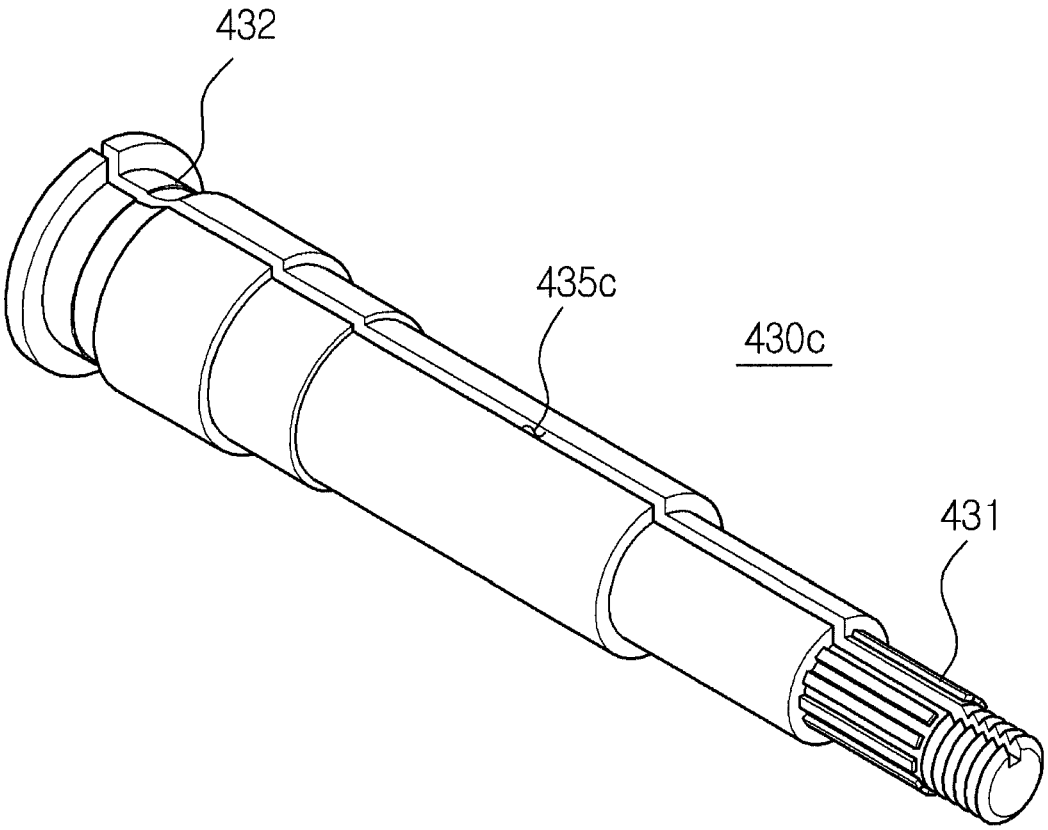
FIG. 4C is a view illustrating a drive shaft in accordance with a further embodiment of the present invention.

FIG. 4C is a view illustrating a drive shaft in accordance with a further embodiment of the present invention.

As illustrated in FIG. 4C, the drive shaft 430*c* has an elongated bar shape and includes a groove 435*c* in a longitudinal direction of the entire drive shaft.

The electric wire 80 is fitted into the groove 435*c* so as to extend from the power-generation unit to the electric device, such as the balancing device (70, see FIG. 1).

Although not illustrated in FIGS. 4A, 4B and 4C, an embodiment in which a drive shaft having no bore or groove is formed as a conductor to be charged with electricity by electric wires connected to both ends of the drive shaft is possible.

Figure 5:
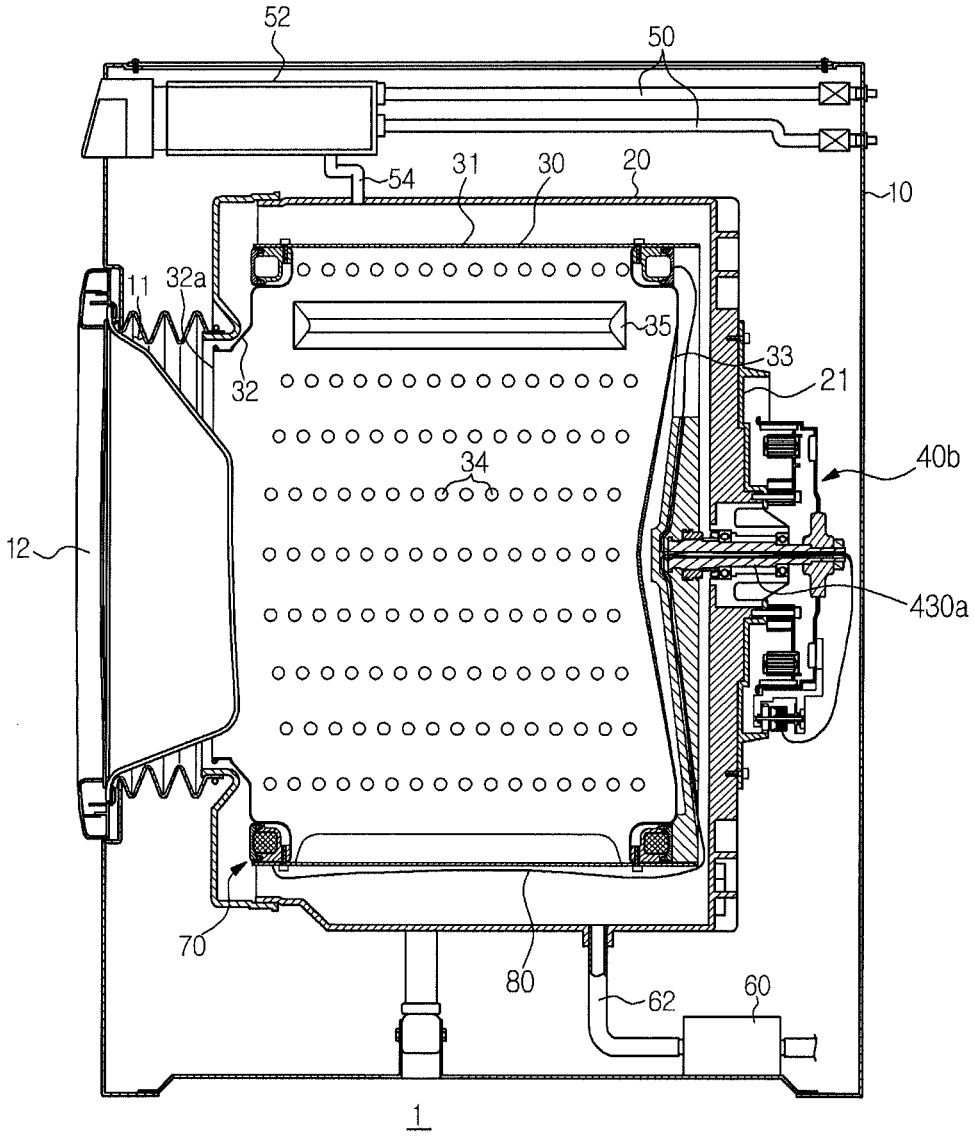
FIG. 5 is a view illustrating the configuration of a washing machine in accordance with another embodiment of the present invention.

FIG. 5 is a view illustrating the configuration of a washing machine in accordance with another embodiment of the present invention.

The general configuration of the washing machine 1 is identical to that described in relation to FIG. 1 and thus, will not be described below.

The electric wire 80, one end of which is connected to a motor 40*b*, extends through the drive shaft 430*a* such that the other end of the electric wire 80 is connected to the balancing device 70, in the same manner as that described in relation to FIG. 1.

Differently from the washing machine 1 of FIG. 1 including the drive shaft 430*b* having a bent bore, the washing machine 1 illustrated in FIG. 5 includes the drive shaft 430*a* having a straight bore in the entire longitudinal direction.

It will be appreciated that various shapes of drive shafts may be applied according to embodiments.

The motor 40*b* of FIG. 5 includes a generator 500.

The generator 500 will be described later.

Figure 6:
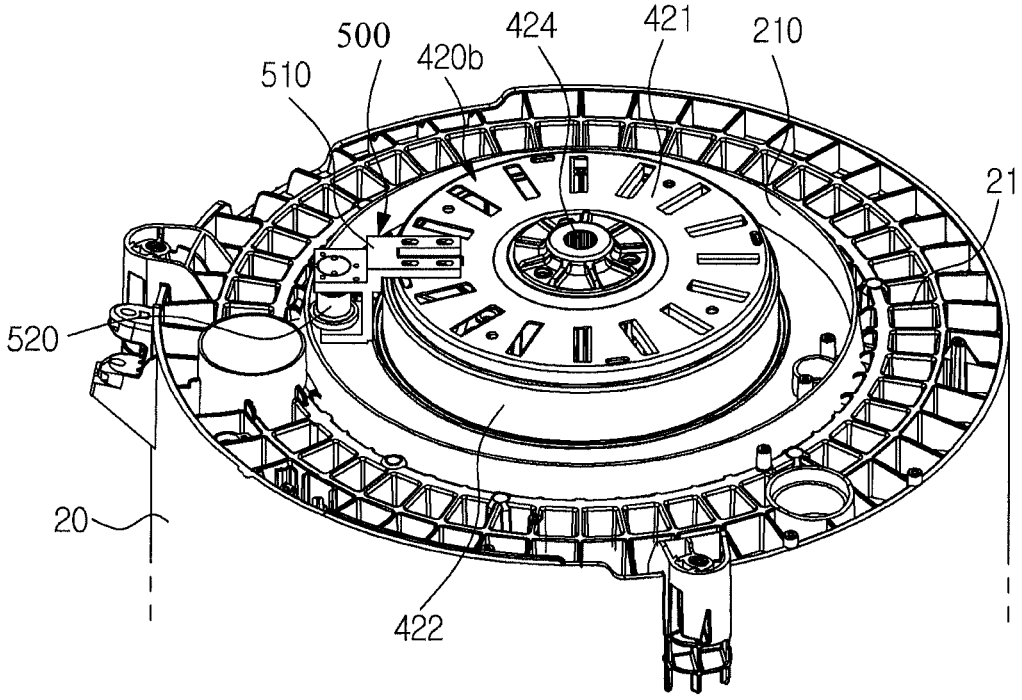
FIG. 6 is a view illustrating a motor usable with a washing machine and a rear surface of a tub in accordance with another embodiment of the present invention.
Figure 7:
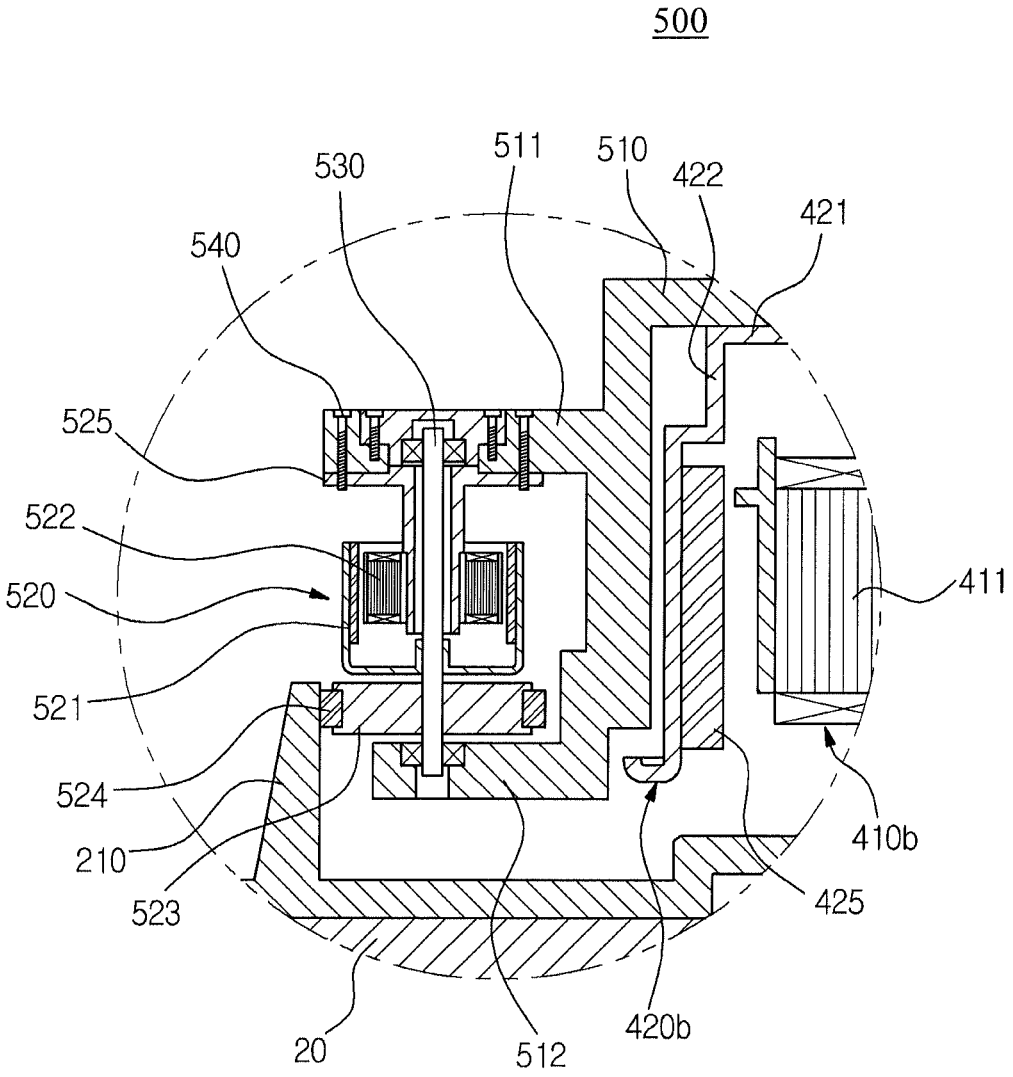
FIG. 7 is a sectional view illustrating a generator of a motor usable with a washing machine in accordance with another embodiment of the present invention.

FIG. 6 is a view illustrating a motor usable with a washing machine and a rear surface of a tub in accordance with another embodiment of the present invention, and FIG. 7 is a sectional view illustrating a generator of a motor usable with a washing machine in accordance with another embodiment of the present invention.

As illustrated in FIGS. 6 and 7, the motor is mounted to the rear surface 21 of the tub 20.

The coupling relationship between the stator and the rotor of the motor is identical to that described in FIGS. 2 and 3 except for the power-generation unit coil and the power-generation unit magnets and thus, a description thereof will be omitted below.

The rear surface 21 of the tub 20 is provided with a rib 210 protruding in a circumferential direction about rotor 420*b* and generator 500.

The generator 500 includes a generating part 520, a rotating part 523 and a support part 510.

The support part 510 is coupled to a rear surface of the bottom 421 of a rotor 420*b* and serves to support the generator 500. The support part 510 extends parallel to the rear surface of the bottom 421 of the rotor 420*b* to protrude outward from the rotor 420*b* and then, is bent at the rim of the rotor 420*b* so as to extend parallel to the sidewall 422.

The support part 510 includes an upper end support 511 and a lower end support 512, which protrude outward from a lateral surface of the sidewall 422.

The generating part 520 and the rotating part 523 are arranged between the upper support 511 and the lower support 512.

The upper end support 511 is coupled with an upper end 525 of the generating part 520 by means of a fastener 540 and serves to support the generating part 520.

The rotating part 523 is placed beneath a lower end of the generating part 520. The rotating part 523 includes a cushion member 524 radially surrounding the rotating part 523.

The cushion member 524 is positioned to come into contact with the rib 210 at the rear surface 21 of the tub 20.

A shaft 530 penetrates the generating part 520 and the rotating part 523, thereby causing the generating part 520 and the rotating part 523 to be rotated together. One end of the shaft 530 is rotatably secured to the upper end support 511 and the other end of the shaft 530 is rotatably secured to the lower end support 512. Bearings 522 may be inserted between the shaft 530 and the upper end and lower end supports 511 and 512 to ensure free rotation of the shaft 530.

Hereinafter, power-generation operation of the generator 500 will be described.

As described above, if the rotor 420*b* is rotated by electromagnetic interaction between the rotor magnets 425 and the stator coil 411 of the stator 410*b*, the generator 500 is rotated together with the rotor 420*b* via the support part 510 coupled to the rotor 420*b*.

If the generator 500 is rotated, the rotating part 523 is rotated in an opposite direction of a rotating direction of the rotor 420*b* via friction between the rotating part 523 and the rib 210 at the rear surface 21 of the tub 20.

Simultaneously with rotation of the rotating part 523, the generating part 520 is rotated by the shaft 530, thereby generating electric power.

The electric power generated by the generating part 520 is transmitted to the electric device via the electric wire (80, see FIG. 5). The electric wire 80 may extend from the motor (40*b*, see FIG. 5) into the tub 20 through the drive shaft (430*a*, see FIG. 5).

Figure 8:
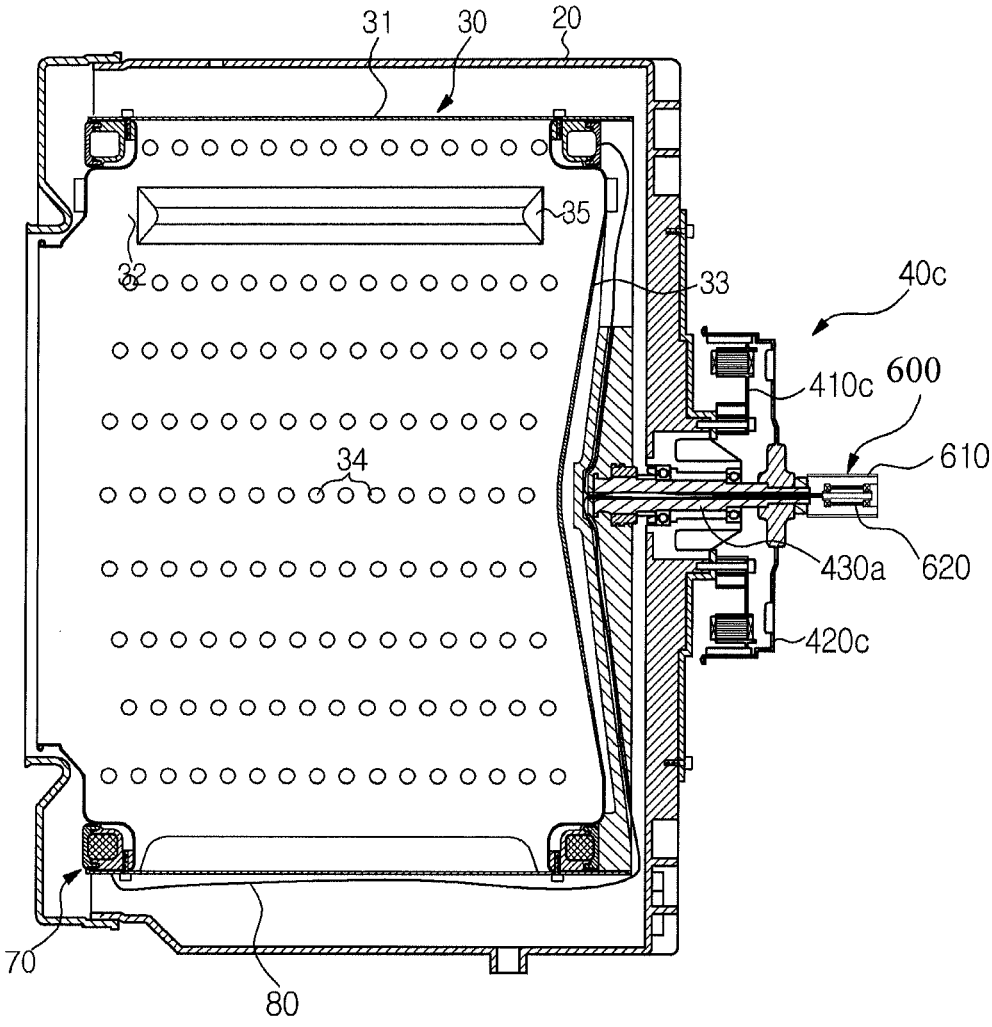
FIG. 8 is a view illustrating the configuration of a washing machine in accordance with a further embodiment of the present invention.

FIG. 8 is a view illustrating the configuration of a washing machine in accordance with a further embodiment of the present invention.

The general configuration of the washing machine 1 is identical to that described in relation to FIG. 1 and thus, will not be described below.

As illustrated in FIG. 8, a slip ring 60 is coupled to the rear surface of a rotor 420*c*. The slip ring 600 includes a body 610 to secure the slip ring 600 to the rotor 420*c* and a rotating part 620 rotatably provided in the body 610.

The electric wire 80 extending through the drive shaft is connected to the rotating part 620. The rotating part 620 is configured to maintain rotation of the electric wire 80 without twisting even if the drum 30 is rotated.

The slip ring 600 receives electric power from an external power source and supplies the electric power to the electric device such as the balancing device 70. The slip ring 600 prevents twisting of the electric wire 80 despite rotation of the drum 30.

As is apparent from the above description, according to an aspect, electric power may be supplied to an electric device mounted within a drum through a drive shaft having a simplified configuration.

The electric power to be supplied to the electric device may be generated by a motor without a separate power source.

The disclosure herein has provided example embodiments of a motor usable with a washing machine and a washing machine having the same. However the disclosure is not limited to particular embodiments described herein. For example, although the drum has been described as being configured to accommodate laundry, items other than laundry may be placed in the drum. Additionally, although an example of fastening members includes bolts, other fastening members or fasteners, may include, but are not limited to, screws, pins, rivets, anchors, or alternatively, adhesives, etc., so long as the desired performance may be achieved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a tub;

a drum rotatably placed within the tub;

at least one electric device mounted to the drum;

a motor including a ring-shaped stator mounted to a rear wall of the tub and a rotor placed around the stator, the rotor being rotatable via electromagnetic interaction with the stator;

an electric power generating device including a power-generation unit to generate electric power to be transmitted to the at least one electric device via driving of the motor and a hollow drive shaft having one end connected to a rear plate of the drum and an other end connected to the motor; and an electric wire passing through the hollow drive shaft.

2. The washing machine according to claim 1, wherein the power-generation unit includes:

a plurality of magnets affixed in a circumferential direction to a surface of the stator adjacent to the rotor; and a plurality of coils affixed in the circumferential direction at positions corresponding to the plurality of magnets to a surface of the rotor adjacent to the stator, and wherein the power-generation unit generates electric power by electromagnetic interaction between the plurality of magnets and the plurality of coils.

3. The washing machine according to claim 1, wherein the power-generation unit includes:

a rib protruding rearward from a rear surface of the tub in a circumferential direction; and a generator placed at a radial lateral surface of the rotor so as to come into contact with the rib, the generator being rotatable about an axis thereof, and wherein the generator generates electric power by being rotated via friction with the rib when the rotor is rotated by an external power source.

4. The washing machine according to claim 1, wherein the hollow drive shaft is configured to define a passage to transmit rotational power of the motor to the drum and to transmit electric power generated by the power-generation unit to the at least one electric device.

5. The washing machine according to claim 4, wherein the hollow drive shaft comprises a hollow circular column to allow passage of the electric wire.

6. The washing machine according to claim 4, wherein the hollow drive shaft is formed of a circular column and includes a longitudinal groove in a curved peripheral surface of the circular column to allow passage of the electric wire along the groove.

7. The washing machine according to claim 4, wherein the hollow drive shaft is formed as a conductor to transmit electricity.

8. The washing machine according to claim 1, wherein the at least one electric device includes a balancing device drive unit.

9. The washing machine according to claim 1, wherein the at least one electric device includes a light emitting unit to illuminate an interior of the drum.

10. The washing machine according to claim 1, further comprising:

a cabinet, wherein the tub is disposed in the cabinet, and the drum is configured to accommodate laundry therein.

11. The washing machine according to claim 1, wherein the motor is driven by an external power source.

12. A washing machine comprising:

a cabinet;

a tub placed within the cabinet;

a drum rotatably placed within the tub;

at least one electric device mounted to the drum and operable by electric power;

a motor mounted to a rear wall of the tub to rotate the drum;

a power source placed within the cabinet to supply electric power to the at least one electric device;

a hollow drive shaft having one end connected to a rear plate of the drum and an other end connected to the motor, the drive shaft being configured to transmit rotational power of the motor to the drum; and an electric wire passing through the hollow drive shaft to extend to the at least one electric device.

13. The washing machine according to claim 12, wherein the hollow drive shaft comprises a hollow circular column to allow passage of the electric wire.

14. The washing machine according to claim 12, wherein the hollow drive shaft is formed of a circular column and includes a longitudinal groove in a curved peripheral surface of the circular column to allow passage of the electric wire along the groove.

15. The washing machine according to claim 12, wherein the hollow drive shaft is formed as a conductor to transmit electricity.

16. The washing machine according to claim 12, wherein the electric power supplied by the power source is transmitted to the at least one electric device through the hollow drive shaft.

17. The washing machine according to claim 16, further comprising a slip ring provided behind the motor to enable supply of electric power from the power source to the at least one electric device.

18. A washing machine comprising:

a tub;

a drum rotatably placed within the tub;

a ring-shaped stator mounted to a rear wall of the tub;

a rotor placed to surround the stator and to rotate the drum;

an electric power generating device including a power-generation unit including:

a plurality of magnets affixed in a circumferential direction to a surface of the stator adjacent to the rotor; and a plurality of coils affixed to an inner surface of the rotor at positions corresponding to the plurality of magnets;

a hollow drive shaft connected to a rear surface of the drum, one end of the drive shaft protruding rearward from a rear surface of the tub connected to the rotor, the hollow drive shaft comprising a hollow circular column; and an electric wire having one end connected to the plurality of coils, the electric wire passing through the hollow drive shaft and extending along an outer surface of the drum.

19. A washing machine comprising:

a tub;

a drum rotatably placed within the tub;

a ring-shaped stator mounted to a rear wall of the tub;

a rotor placed to surround the stator and to rotate the drum;

a rib protruding rearward from a rear surface of the tub in a circumferential direction;

a generator placed between a radial lateral surface of the rotor and the rib and adapted to rotate about an axis thereof;

a hollow drive shaft connected to a rear surface of the drum, one end of the drive shaft protruding rearward from the rear surface of the tub connected to the rotor, the hollow drive shaft comprising a hollow circular column; and an electric wire having one end connected to the generator, the electric wire passing through the hollow drive shaft and extending along an outer surface of the drum.

20. The washing machine according to claim 19, wherein the generator comprises:

a generating part;

a rotating part including a cushion member to contact the rib;

a support part coupled to a rear surface of a bottom portion of the rotor, to support the generator, wherein a shaft penetrates the generating part and rotating part to cause the generating part and rotating part to rotate together.

21. The washing machine according to claim 20, wherein when the generator is rotated, the generating part rotates in a direction opposite to a rotation direction of the rotor via friction between the rotating part and the rib, and when the rotating part rotates, the generating part is rotated by the shaft to generate electric power.

22. A washing machine comprising:

a cabinet;

a tub;

a drum rotatably placed within the tub;

a ring-shaped stator mounted to a rear wall of the tub;

a rotor placed to surround the stator to rotate the drum;

a power source placed between a rear surface of the tub and an inner wall of the cabinet to supply electric power;

a hollow drive shaft connected to the rear surface of the drum, one end of the hollow drive shaft protruding rearward from the rear surface of the tub connected to the rotor, the hollow drive shaft comprising a hollow circular column;

an electric wire having one end connected to the power source, the electric wire passing through the hollow drive shaft and extending along an outer surface of the drum; and a slip ring provided behind the rotor to prevent twisting of the electric wire, including when the rotor is rotated.

23. A washing machine, comprising:

a tub;

a drum rotatably placed within the tub; and a motor mounted to the tub, the motor including:

a ring-shaped stator;

a rotor placed around the stator and rotatable via electromagnetic interaction with the stator when external power is applied;

a hollow drive shaft having one end connected to the rotor to rotate together with the rotor;

a power-generation unit to generate electric power separately from the external power; and an electric wire passing through the hollow drive shaft.

24. The washing machine according to claim 23, wherein the hollow drive shaft comprises a hollow circular column to allow passage of the electric wire.

25. The washing machine according to claim 23, wherein the power-generation unit includes:

a plurality of magnets affixed in a circumferential direction to a surface of the stator adjacent to the rotor; and a plurality of coils affixed in the circumferential direction at positions corresponding to the plurality of magnets to a surface of the rotor adjacent to the stator.

26. The washing machine according to claim 23, wherein the power-generation unit includes:

a generator placed at a radial lateral surface of the rotor, the generator being rotatable about an axis thereof; and a rib placed to surround the rotor so as to come into contact with a surface of the generator, an opposite surface of the generator being adjacent to the rotor.

27. A washing machine, comprising:

a tub;

a drum rotatably placed within the tub; and a motor mounted to the tub, the motor including:

a ring-shaped stator;

a rotor placed around the stator and rotatable via electromagnetic interaction with the stator;

a power-generation unit to generate electric power;

a hollow drive shaft having one end connected to the rotor to rotate together with the rotor, the hollow drive shaft comprising a hollow circular column;

an electric wire connected to the power-generation unit and passing through the hollow drive shaft; and a slip ring provided behind the rotor, to allow the electric wire to extend through the hollow drive shaft and to prevent twisting of the electric wire if the rotor is rotated.

* * * * *